US008544703B2

(12) United States Patent
Fischer

(10) Patent No.: US 8,544,703 B2
(45) Date of Patent: Oct. 1, 2013

(54) INJECTION CHAMBER FOR A METAL INJECTION MACHINE

(75) Inventor: Wilmar Fischer, Joinville-SC (BR)

(73) Assignee: W. Fischer Tecnica Ltda., Joinville-SC (BR)

( * ) Notice: Subject to any disclaimer, the term of this patent is extended or adjusted under 35 U.S.C. 154(b) by 434 days.

(21) Appl. No.: 12/804,121

(22) Filed: Jul. 14, 2010

(65) Prior Publication Data

US 2011/0011900 A1 Jan. 20, 2011

(30) Foreign Application Priority Data

Jul. 16, 2009 (BR) ..... 0902448

(51) Int. Cl.
*B22D 37/00* (2006.01)
*B22D 39/00* (2006.01)
*B22D 41/00* (2006.01)

(52) U.S. Cl.
USPC ..... 222/596; 222/598; 222/599; 222/600; 164/312; 266/236

(58) Field of Classification Search
USPC ..... 222/596, 598, 599, 600; 164/312; 266/236
See application file for complete search history.

(56) References Cited

U.S. PATENT DOCUMENTS

2005/0056978 A1* 3/2005 Fujikawa ..... 266/200

* cited by examiner

*Primary Examiner* — Lois Zheng
(74) *Attorney, Agent, or Firm* — Harrington & Smith

(57) ABSTRACT

The injection chamber (CI) includes a tubular body formed by a supply portion, having a radial supply window to receive a charge of molten metal (MF) and in which is incorporated an injection portion provided with an outlet end opened to the interior of a molding cavity. A piston is provided to be displaced in the interior of the tubular body to inject the molten metal (MF) in the molding cavity. The supply portion has its inner region, which receives the pouring impact of the charge of molten metal (MF), lined by an insert formed in a high melting point material and presenting an inner contour in the form of a circle arc coinciding with that of the supply and injection portions.

18 Claims, 10 Drawing Sheets

INJECTION CHAMBER FOR A METAL INJECTION MACHINE

FIELD OF THE INVENTION

The present invention refers to an injection chamber to be operatively coupled to a molten metal injection machine, used in the injection molding, by pressure, of pieces formed in metallic alloys of aluminum or other light metals, said injection chamber being constructed to better resist early erosion in its inner region, in which the hot molten metal is poured, and also to minimize its temperature variations upon operation, avoiding the damaging effects of the thermal expansion in the operation of the injection piston, as well as of an untimely and excessive cooling of the molten metal being processed.

BACKGROUND OF THE INVENTION

As illustrated in FIG. 1 of the enclosed drawings, the known injection machines of liquid metal, generally aluminum, are provided with a base portion 1, in which a fixed mold portion 2 is affixed, configured to cooperate with a movable mold portion 3, which is displaced between an open position (not illustrated) and a closed position, illustrated in FIG. 1, in which it defines a molding cavity 4 with the fixed mold portion 2 in a well known prior art constructive arrangement.

The base portion 1 of the injection machine carries a tubular body 10 transversally extended along the fixed mold portion 2 and which is designed to internally define a cylindrical and elongated injection chamber CI. Said tubular body 10 is generally horizontally disposed and presents a closed mounting end 11, through which is tightly slidably mounted a rod 5*a* of a piston 5 axially displaced in the interior of the injection chamber CI, between a retracted position, as illustrated in FIG. 1, in which said piston 5 is retracted close to the mounting end 11 of the tubular body 10, and an injection position, which is reached after said piston 5 is displaced throughout the injection chamber CI, close to an outlet end 12 of the tubular body 10, opposite to the mounting end 11 and opened to the interior of the molding cavity 4, compressing a charge of molten metal MF, already fed to the interior of the injection chamber CI, to the interior of the molding cavity 4.

The charge of molten metal MF is fed into the injection chamber CI, generally through a shell 6 (or chute coming from a dosing furnace) of known construction, and through a supply window 13, radially provided in the tubular body 10, close to the mounting end 11 of the latter, but in a position axially ahead of the piston 5, when in its retracted inoperative position.

In this type of construction, when the molten metal MF is poured to the inside of the injection chamber CI, through the supply window 13, there occurs heat exchange from the molten metal MF to the tubular body 10 of the injection chamber CI. Depending on the metal volume to be supplied and on the time for pouring the charge required for each injection cycle, said heat exchange can be of such magnitude that the usual temperature control systems are insufficient to maintain the wall temperature of the tubular body 10, in the region which receives the pouring of the molten metal MF, within acceptable values which do not alter the characteristics of the conventional hot-work steel or metallic alloy, in the formation of the tubular body 10.

In the case of aluminum, for example, the temperature of the molten metal MF is of about 680 degrees Centigrade and, depending on the charge and on the time of each pouring operation, the adjacent wall region of the tubular body 10 can be excessively heated, reaching temperatures capable of altering the microstructure of the conventional hot-work steel, provoking surface stresses and generating cracks which tend to progressively increase, leading to an early erosion of the inner region of the tubular body 10, against which the charge of molten metal MF is poured.

As is known by those skilled in the art, the erosion of the inner region of the injection chamber CI allows the molten metal to be housed in this eroded region, impairing the liquid metal injection process, as well as damaging the chamber and the piston in a degree capable of causing the binding of the piston and the consequent destruction of the piston-chamber assembly.

The inconvenience related to the early erosion mentioned above is even more harmful to the machine and to the efficiency of its operation, when the temperature control system of the tubular body is designed only for cooling the region subjected to the heating provoked by the pouring of the molten metal MF.

The limitations regarding the wall thickness of the tubular body 10 impair the provision of linings and also the adequate dimensioning of the temperature control system, making it incapable of preventing the temperature from quickly and undesirably rising in each pouring and injection cycle of molten metal MF, mainly in the cases of large pouring volumes, which occurs in injection chambers having a diameter of 100 mm or more. In these cases, the undue heating of the tubular body 10 and the early erosion are unavoidable.

In the systems in which there is no effective control of the temperature of the tubular body 10, but only the cooling to reduce the heating degree of the injection chamber, generally there occurs another problem resulting from the undue cooling of the molten metal remaining in the interior of the chamber, between two injection cycles. This metal tends to cool and modify the microstructure of the piece to be produced in the mold, making said microstructure inappropriate and also producing a "cold junction".

SUMMARY OF THE INVENTION

As a function of the drawbacks mentioned above and related to the early erosion and to the temperature control in the injection chambers of the type considered herein, it is a generic object of the present invention to provide an injection chamber for a metal injection machine, to be used for molding metallic pieces and presenting an increased resistance to early erosion, regardless of the volume and the molten metal pouring volume and time in each injection cycle of the machine.

It is a further object of the present invention to provide an injection chamber as mentioned above and which avoids the cooling of the liquid metal and the change of its microstructure, which could bring negative consequences on the quality of the injected end-piece.

These and other objects of the present invention are attained through an injection chamber for a metal injection machine, provided with mold portions which define a molding cavity, said injection chamber comprising: a tubular body, having cylindrical inner surface and being formed by a supply portion provided with a closed mounting end and with a radial supply window for pouring a charge of molten metal into the interior of the injection chamber, and by an injection portion coaxially incorporated to the supply portion and provided with an outlet end opened to the interior of the molding cavity; and a piston, to be axially displaced in the interior of the tubular body, between a retracted position adjacent to the mounting end and an injection position adjacent to the outlet end.

According to the invention, the supply portion of the tubular body, formed in a single piece or in a separate piece in relation to the injection portion, has at least the region of its cylindrical inner surface, which receives the impact of the charge of molten metal downwardly poured through the radial supply window, lined by an insert formed in a single piece or in a plurality of insert portions made of a high melting point material, for example, a metallic alloy containing high tungsten content, or also sialon, cermet or a ceramic material, to be preferably molded by sintering and presenting a cross section with its inner contour in the form of a circle arc coinciding with that of the supply and injection portions and with the outer contour contained inside the outer contour of the supply portion.

The construction proposed by the invention permits the inner region of the supply portion, which is submitted to the impact of the charge of molten metal poured in the injection chamber, to be protected by the insert formed in a metallic alloy or any other high temperature-resistant material, preventing early erosion of this region and the consequent inconveniences of said erosion.

Besides the provision of the insert, the invention provides means for controlling the temperature in the thickness of the lower half of the supply portion, which means are capable of guaranteeing not only the necessary cooling of this region of the injection chamber, but also the temperature control of the latter, so as to avoid unduly cooling the charge of molten metal remaining inside the injection chamber, between the injection cycles.

BRIEF DESCRIPTION OF THE DRAWINGS

The invention will be described below, with reference to the enclosed drawings, given by way of example of an embodiment of the invention and in which.

DETAILED DESCRIPTION OF THE INVENTION

Figure 1:
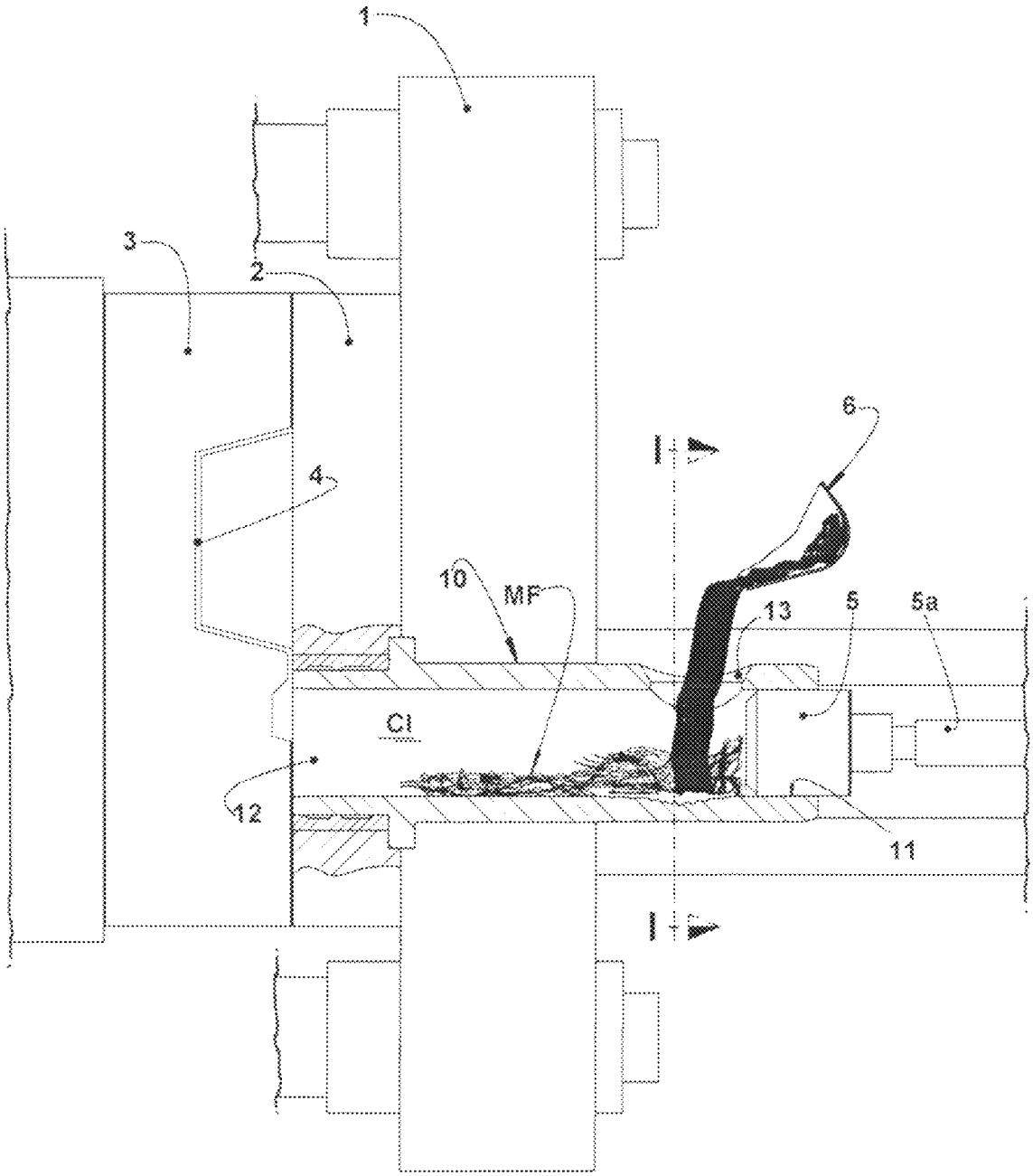
FIG. 1 PRIOR ART
FIG. 1 represents a simplified and somewhat schematic longitudinal sectional view of a metal injection chamber, constructed according to the prior art and associated with a pair of injection molds of an injection machine, the molds being shown in the closed condition and the injection chamber receiving the pouring of a charge of molten metal.

As illustrated and already mentioned, the invention refers to an injection chamber to be applied to an injection machine used in the injection molding, by pressure, of pieces formed in metallic alloys of aluminum and other light metals, said injection machine being of the type described in the introduction of the present specification and illustrated in FIG. 1 of the enclosed drawings.

The injection chamber CI comprises a tubular body 10, having a cylindrical inner surface 14 and being formed by a supply portion 10*a* provided with a closed mounting end 11, which is trespassed by the rod 5*a* of the piston 5 and provided with a radial supply window 13, through which a charge of molten metal MF is poured in the interior of the injection chamber CI. The tubular body 10 has also an injection portion 10*b*, coaxially incorporated to the supply portion 10*a* and provided with an outlet end 12 opened to the interior of the molding cavity 4.

The piston 5 is axially displaced in the interior of the tubular body 10, between a retracted position adjacent to the mounting end 11 and an injection position adjacent to the outlet end 12.

According to the invention, the supply portion 10*a* of the tubular body 10 is constructed so as to have at least the region of its cylindrical inner surface 14, which receives the impact of the charge of molten metal MF downwardly poured through the radial supply window 13, lined by an insert 20, formed in a metallic alloy of high melting point, for example, a metallic alloy containing about 90% of Tungsten, 4% of nickel, 4% of molybdenum and 2% of iron, to be preferably molded by sintering, and presenting a cross section with its inner contour in the form of a circle arc coinciding with that of the supply portion 10*a* and of the injection portion 10*b* and with the outer contour contained in the outer contour of the supply portion 10*a*. It should be understood that different high melting point alloys can be used with compositions different from that presented above, given by way of example only. Other materials can be defined by, for example, sialon, cermet or a ceramic material.

In the embodiment illustrated in FIGS. 2, 2A, 3 and 3A, the insert 20 comprises a plurality of insert portions 21 disposed axially in relation to the axis of the injection chamber CI and adjacent to each other, side-by-side, each insert portion 21 presenting a preferably trapezoidal cross section with the smaller base, in a concave circular arc, being turned radially inwards. This embodiment, better illustrated in FIGS. 3 and 3A, allows the insert portions to be produced in separate pieces mounted in the interior of the supply portion 10*a* of the tubular body 10, so as to define the cylindrical inner surface 14 of the injection chamber CI in the region in which said insert 20 is provided.

Figure 3:
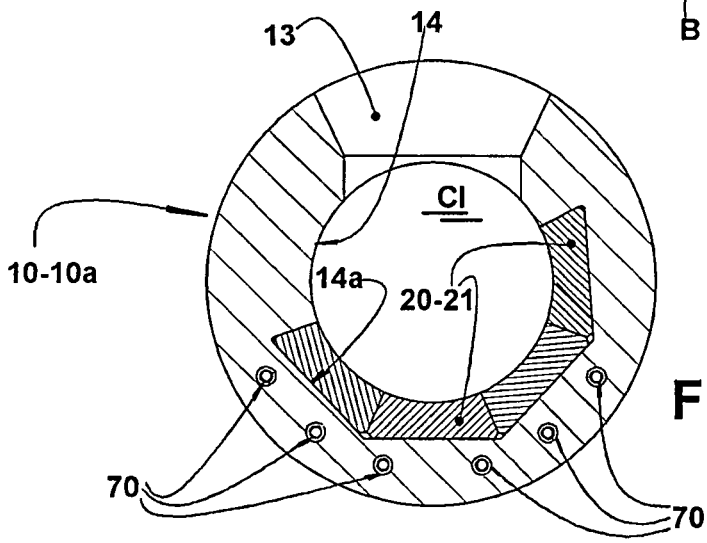
FIG. 3 represents a cross-sectional view of the injection chamber, said section taken according to line III-III in FIG. 2.
Figure 3A:
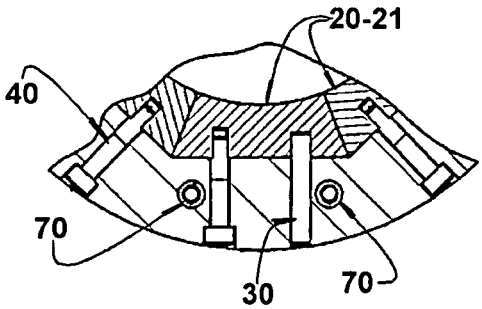
FIG. 3A represents an enlarged detailed view of the lower region of the supply portion illustrated in FIG. 3, said view illustrating a different construction for locking the insert in the supply portion, utilizing pins and/or screws.
Figure 5:
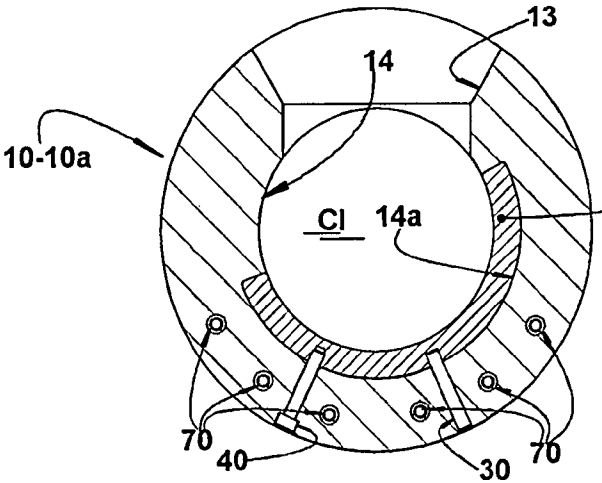
FIG. 5 represents a cross-sectional view of the injection chamber, said section taken according to line V-V in FIG. 4.

In order that the insert portions 21 can be adequately adapted in the thickness of the supply portion 10*a* of the tubular body 10, the insert 20, defined in a single piece or in said insert portions 21, is seated in a respective recess 14*a* provided on the cylindrical inner surface 14 of the supply portion 10*a*, being locked therein, in the axial and radial directions, by pins 30 and/or screws 40 which are radially provided in appropriate holes of the tubular body 10, as better illustrated in FIGS. 3A and 5.

In the constructive form illustrated in FIGS. 2, 2A, 3 and 3A, a need exists for axially locking the insert portions 21, so that they are not displaced in the direction of the mounting end 11 of the tubular body 10 upon the return of the piston 5, this axial locking being carried out, for example, by the pins 30 radially provided through the tubular body 10. However, in this same construction of the insert portions 21, it can be desirable to further obtain an adequate and reliable radial locking of the insert portions 21 in the interior of the recess 14*a*, so as to guarantee a perfect positioning of the smaller base in a concave circular arc of said insert portions 21 in relation to the remainder of the cylindrical inner surface 14 of the injection chamber CI. This radial locking can be obtained by the screws 40.

Figure 1A:
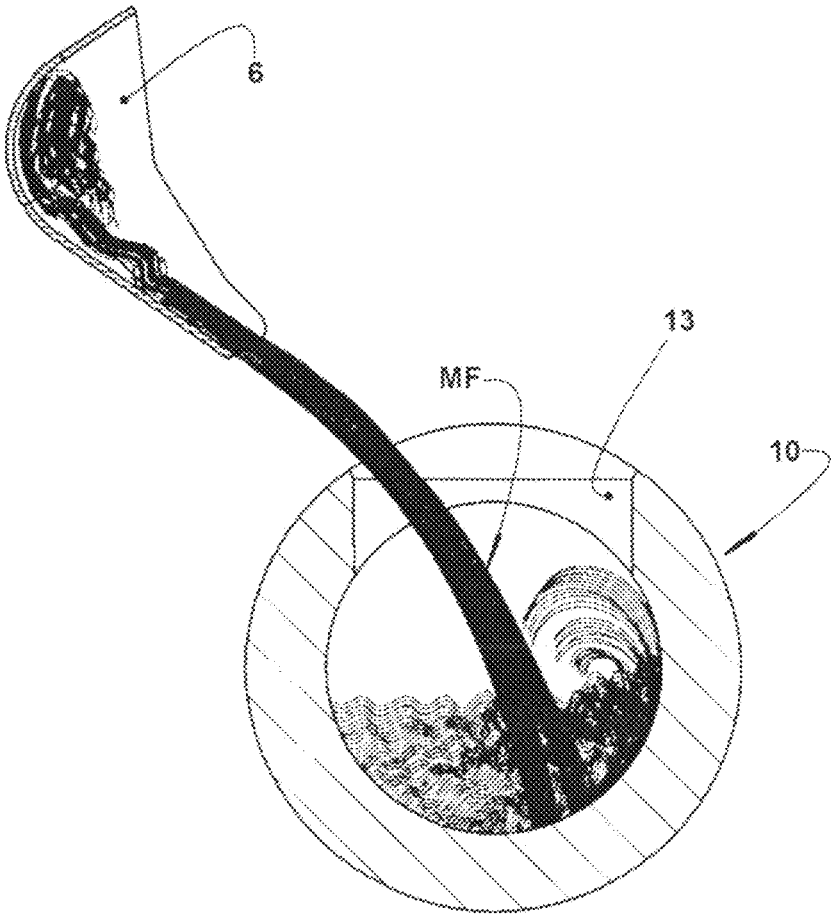
FIG. 1A PRIOR ART
FIG. 1A represents a somewhat simplified and schematic cross-sectional view of the injection chamber illustrated in FIG. 1, said section taken according to line I-I of said previous figure.
Figure 4:
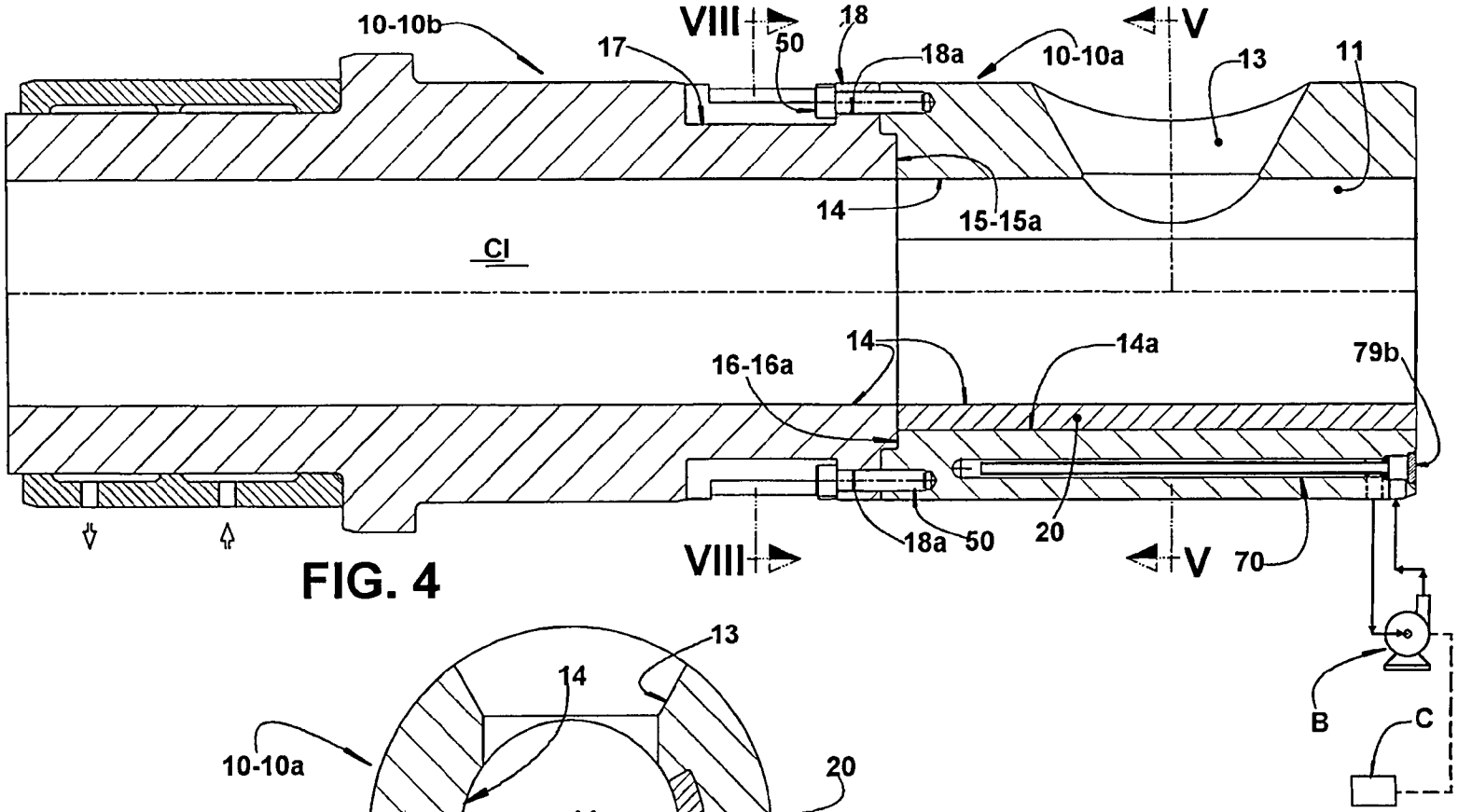
FIG. 4 represents a longitudinal sectional view of the injection chamber, similar to that of FIG. 2, but illustrating the insert constructed in a single piece in the form of a half chute, and also means for affixing the insert in the supply portion, utilizing radial screws and pins, as illustrated in FIG. 5.

In FIGS. 4 and 5, the insert 20 is formed in a single piece, in the form of a half chute turned upwards and lining a lower circumferential extension of the supply portion 10*a*, and having end longitudinal edges disposed in a diametrical plane inclined in relation to the horizontal orientation and orthogonal to the pouring direction of the molten metal MF, so that the internally lined region of the supply portion 10*a* is asymmetric in relation to a vertical diametrical plane containing the axis of the injection chamber CI, allowing the insert region disposed at the side of said diametrical vertical plane, which side is opposite to that of the shell 6 for pouring the molten metal MF, presents a higher height sufficient to protect the interior of the supply portion 10*a* from the impact of the molten metal MF being poured, as better illustrated in FIG. 1A. This half chute shape is also employed in the embodiment illustrated in FIGS. 2 and 3, with the difference that, in the previous embodiment, the half chute shape is obtained with a plurality of insert portions 21 and not only with a single piece, as illustrated in FIGS. 4 and 5.

As can be noted, also in this embodiment for the single-piece insert 20, in the form of half chute, the axial retention and the radial fixation of the insert 20 can be also obtained by using pins 30 and/or screws 40, radially provided through the tubular body 10 and fitted in the thickness of the insert 20, as better illustrated in FIG. 5. As can be also noted in FIG. 5, the insert 20 in a single piece is also housed in a recess 14*a* provided in the cylindrical inner surface 14 of the supply portion 10*a*, the interior of the insert 20 being configured to precisely coincide with the circular arc contour of the cylindrical inner surface 14 of the injection chamber CI.

Figure 6:
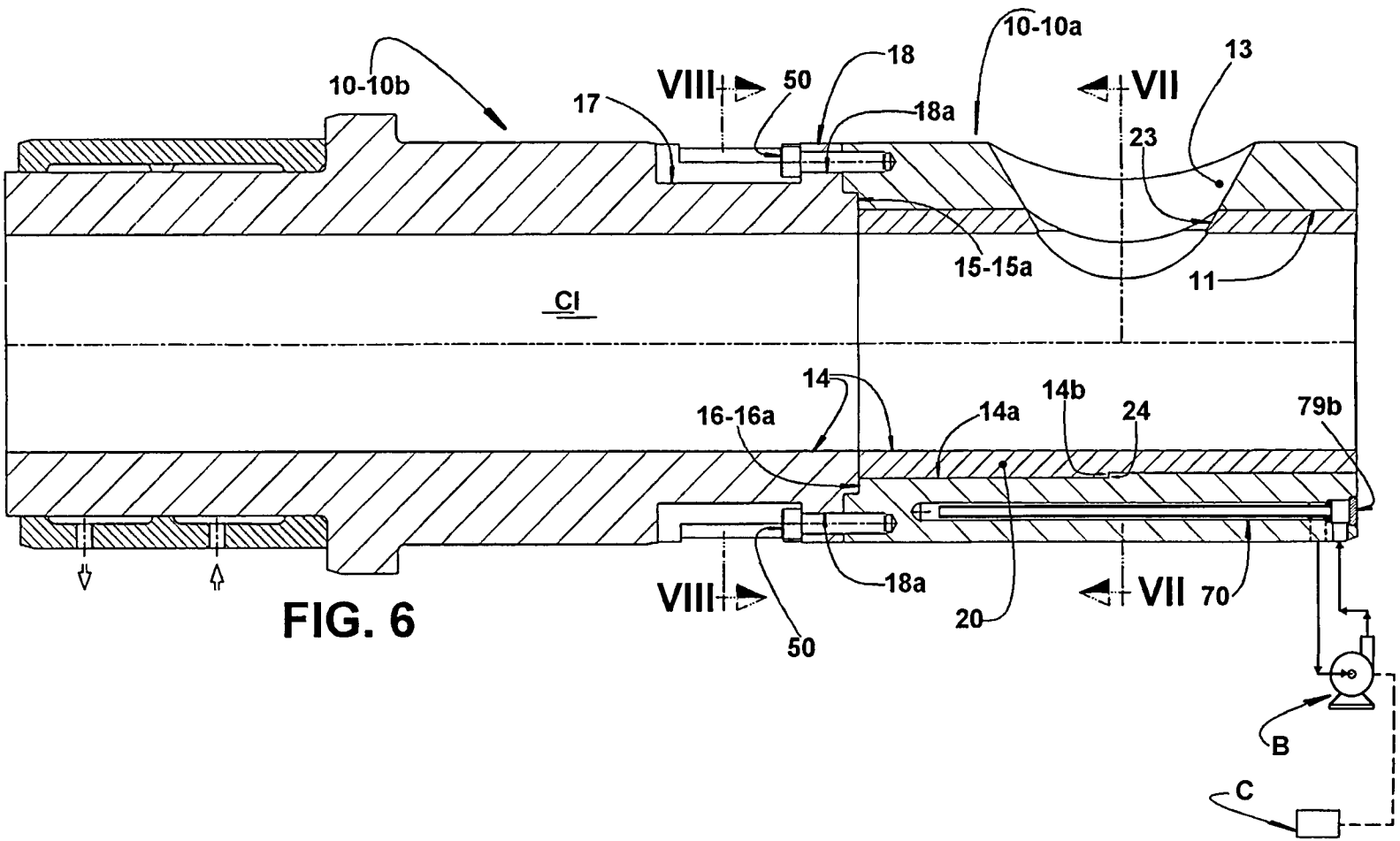
FIG. 6 represents a longitudinal sectional view of the injection chamber, similar to those of FIGS. 2 and 4, but illustrating an insert constructed in a single piece in the form of a cylindrical sleeve, and also another constructive variant for the means for affixing the insert in the supply portion, according to which the radial screws and pins, as illustrated in FIGS. 3A and 5, and the welding illustrated in FIG. 2A, are replaced by the axial seating of steps provided in the insert and in the supply portion.
Figure 7:
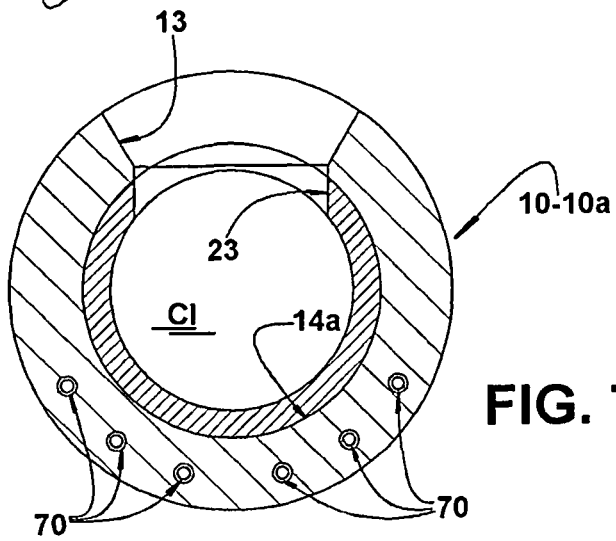
FIG. 7 represents a cross-sectional view of the injection chamber, said section taken according to line VII-VII in FIG. 6.
Figure 8:
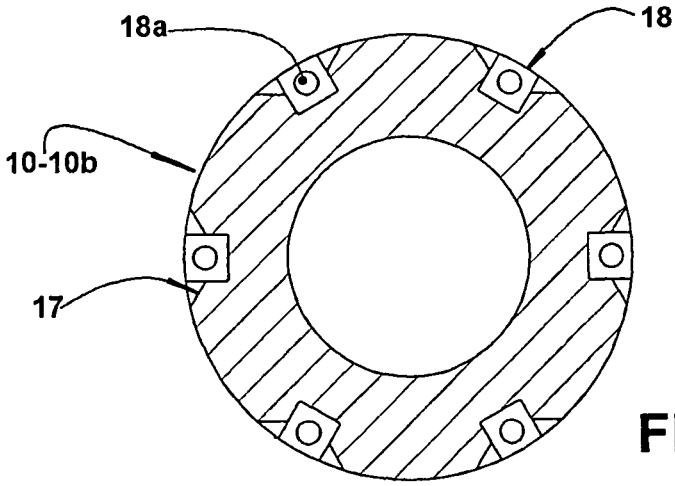
FIG. 8 represents a cross-sectional view of the injection chamber, said section taken according to line VIII-VIII in FIGS. 2, 4 and 6.

In the construction illustrated in FIGS. 6 and 7, the insert 20 is formed in a single piece, in the form of a cylindrical sleeve, lining the whole circumferential extension of the supply portion 10*a* and presenting a radial opening 23 which is aligned with the radial supply window 13 of the supply portion 10*a*, in order to allow the charge of molten metal MF to be poured into the inside of the injection chamber CI. Also in this constructive variant, the insert 20 is seated in the interior of a recess 14*a* provided in the inner surface 14 of the tubular body 10, so that the inner surface in the form of a circle arc of the insert 20 perfectly coincides with the cylindrical inner surface 14 of the tubular body 10.

Although the embodiment of FIGS. 6 and 7 illustrates a different manner of axially retaining the insert 20 in the interior of the supply portion 10*a*, it should be understood that also in this form of insert 20 it is possible to guarantee its axial retention in the interior of the supply portion 10*a*, by means of pins 30 and/or screws 40 of the type already previously described and which are radially disposed through the tubular body 10 and affixing the insert 20. It should be noted that in all the constructive variants for the insert illustrated in FIGS. 2 to 7, the axial retention of the insert 20 is required to be made only in the direction of the mounting end 11, since in the opposite axial direction, the end of the recess 14*a* already defines a stop for axially displacing the insert 20 or the insert portions 21.

As illustrated in FIGS. 2 to 7, the insert 20 or the insert portions 21 are dimensioned for lining, preferably, the whole axial extension of the supply portion 10*a*. However, it should be understood that the axial extension of the insert 20, formed in a single piece or in a plurality of insert portions 21, must be dimensioned for lining at least the inner region of the supply portion 10*a* which is subject to the pouring impact of the molten metal MF and to the superheating as a function of the thermal charge contained in the molten metal MF.

In the constructions of the tubular body 10 illustrated in FIGS. 2 to 7, the supply portion 10*a* and the injection portion 10*b* are defined by different pieces that are coaxially seated and affixed to each other by different manners, as described ahead. However, although not illustrated herein, it should be understood that the supply portion 10*a* and injection portion 10*b* can be perfectly constructed in a single piece, the supply portion 10*a* being internally worked for making the recess 14*a* adequate to receive the insert 20 in a single piece or in a plurality of insert portions 21. In this construction of the tubular body 10 in a single piece, the axial retention of the insert 20, in the interior of the supply portion 10*a*, must be made by the already mentioned pins 30 and/or screws 40 radially housed through the thickness of the tubular body 10 in the region of the supply portion 10*a*.

In the preferred construction, according to which the tubular body 10 is formed in two different pieces defined by the supply portion 10*a* and by the injection portion 10*b*, it is desirable that one of said tubular body portions be provided with an end guide means 15 configured to be axially fitted, in a relatively tight manner, but without interference, in an end guide receiving means 16 provided in the other of said tubular body portions.

Figure 2:
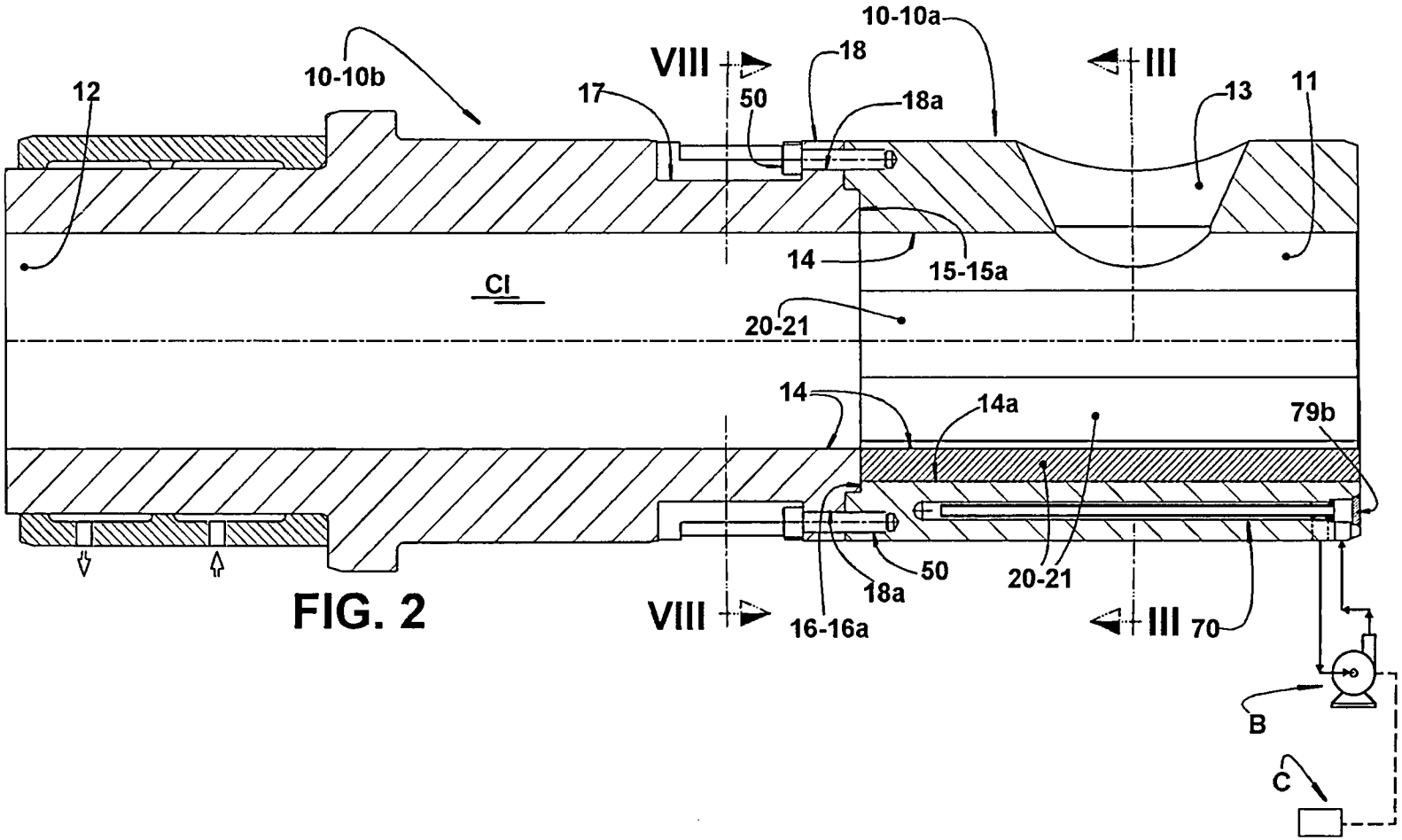
FIG. 2 represents a simplified and enlarged longitudinal sectional view of the injection chamber deprived of the piston and constructed according to a first embodiment of the present invention, according to which the injection chamber is formed by two tubular body portions and the insert is formed by a plurality of insert portions.

More specifically and as particularly illustrated in FIGS. 2, 4 and 6, the end guide means 15 can be defined by a central axial projection 15*a* of one of the injection portion 10*b* and supply portion 10*a*, the end guide receiving means 16 being defined by a central recess 16*a* provided in the adjacent end of the other of said portions of the tubular body 10 and dimensioned to tightly receive the central axial projection 15*a* when the two portions 10*a* and 10*b* of the tubular body 10 are affixed to each other.

According to a constructive form illustrated in FIGS. 2, 4, 6 and 8, the injection portion 10*b* is provided with a plurality of peripheral recesses 17, circumferentially spaced from each other or even circumferentially joined to each other, so as to define an end flange portion 18, said peripheral recesses housing the head of a screw 50 which projects through a hole 18*a* in the respective end flange portion 18, so as to be engaged in an end threaded hole of the supply portion 10*a*, allowing the fixation of the latter in the injection portion 10*b*.

Figure 2A:
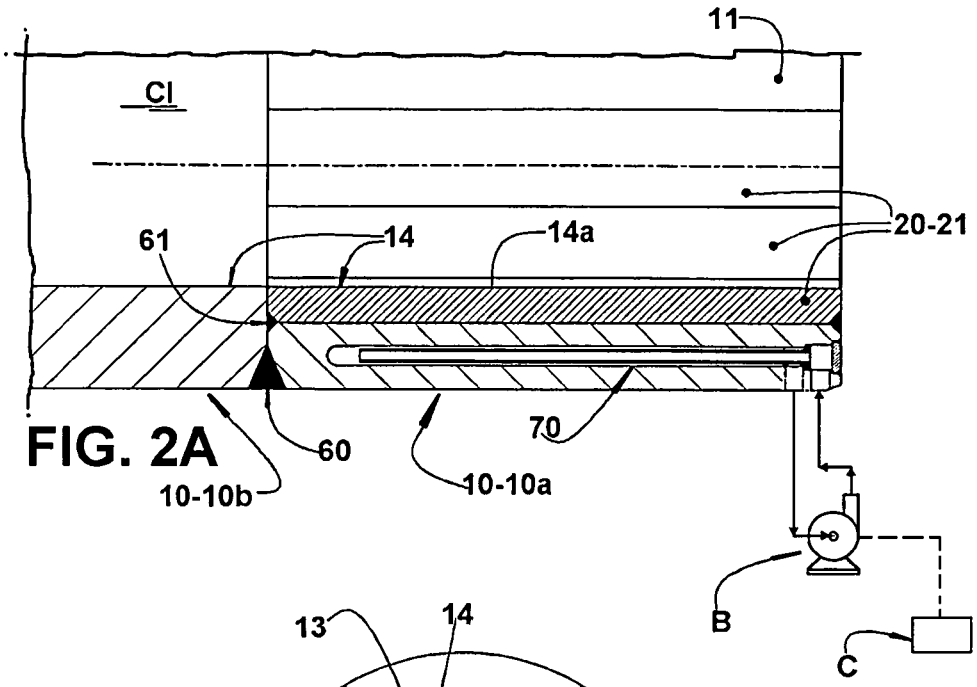
FIG. 2A represents an enlarged detail of the lower region of the supply portion illustrated in FIG. 2, but illustrating a different construction for affixing the two tubular body portions and also for locking the insert in the interior of the supply portion, utilizing welding.

However, as illustrated in FIG. 2A, the supply portion 10*a* and injection portion 10*b*, which is constructed in separate pieces, can be affixed to each other, in the mutual seating region, by a peripheral welding 60.

Figure 6A:
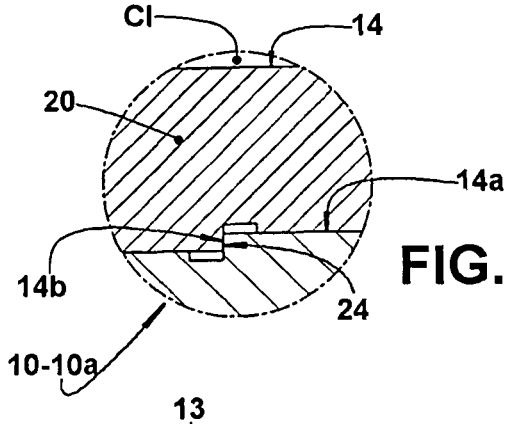
FIG. 6A represents an enlarged detail of the median lower region of the supply portion illustrated in FIG. 6, in order to show the solution of axially retaining the insert in the interior of the supply portion.

FIGS. 6 and 6*a* illustrate a constructive variant for axially locking the insert 20 in the interior of the supply portion 10*a*, this constructive variant being preferably applied when the insert 20, in a single piece, presents a shape which dispenses the need of being radially locked against the tubular body 10. In this constructive variant, the recess 14*a* of the region of the cylindrical inner surface 14 of the supply portion 10*a*, which recess is lined with the insert 20, presents a median step 14*b* turned to the injection portion 10*b*, the insert 20 being provided with an inverted step 24, turned to the mounting end 11 and which is seated against the median step 14*b*, so as to lock the insert 20 against axial displacements towards the mounting end 11. It should be noted that this type of axial locking of the insert 20 can be only applied in the constructions in which the tubular body 10 is formed in two distinct pieces defined by the supply portion 10*a* and by the injection portion 10*b*.

FIG. 2A illustrates another constructive variant for securing the insert 20 in the tubular body 10. In this construction, the insert 20 has its opposite ends affixed to the supply portion 10*a* by a respective welding 61 which can be continuous throughout the whole edge of the insert or defined by welding points circumferentially spaced from each other.

Figure 9:
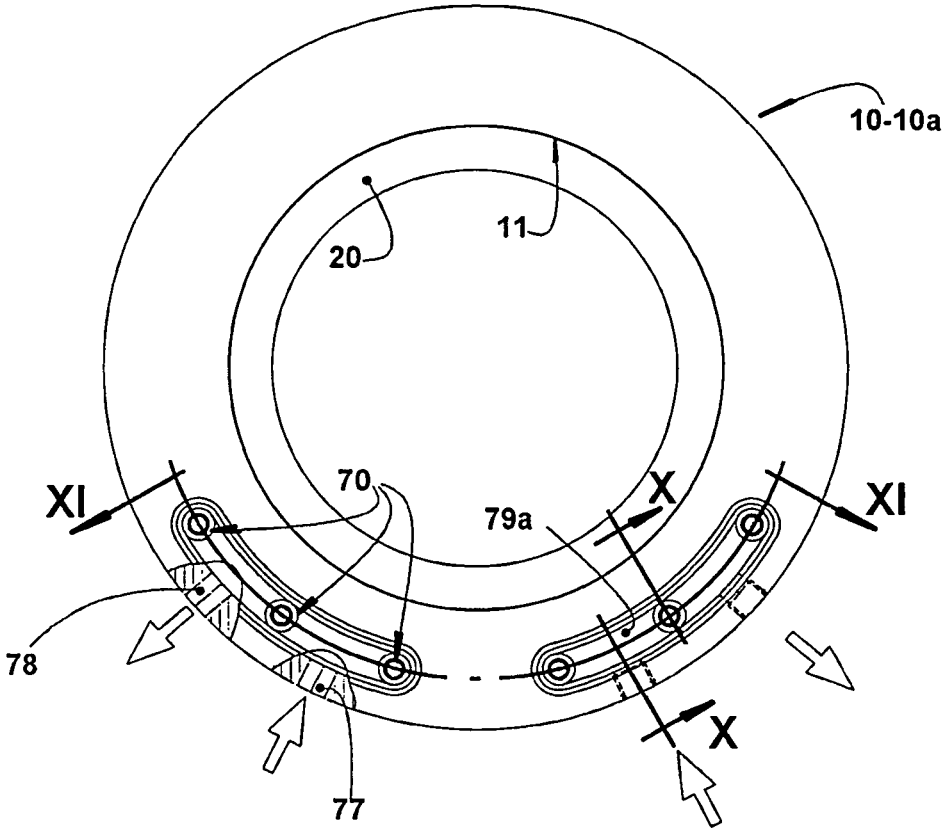
FIG. 9 represents a schematic end view of the supply portion illustrated in FIG. 6, taken from the mounting end of the tubular body, in order to illustrate a possible positioning for the elements related to the control of the supply portion temperature.
Figure 10:
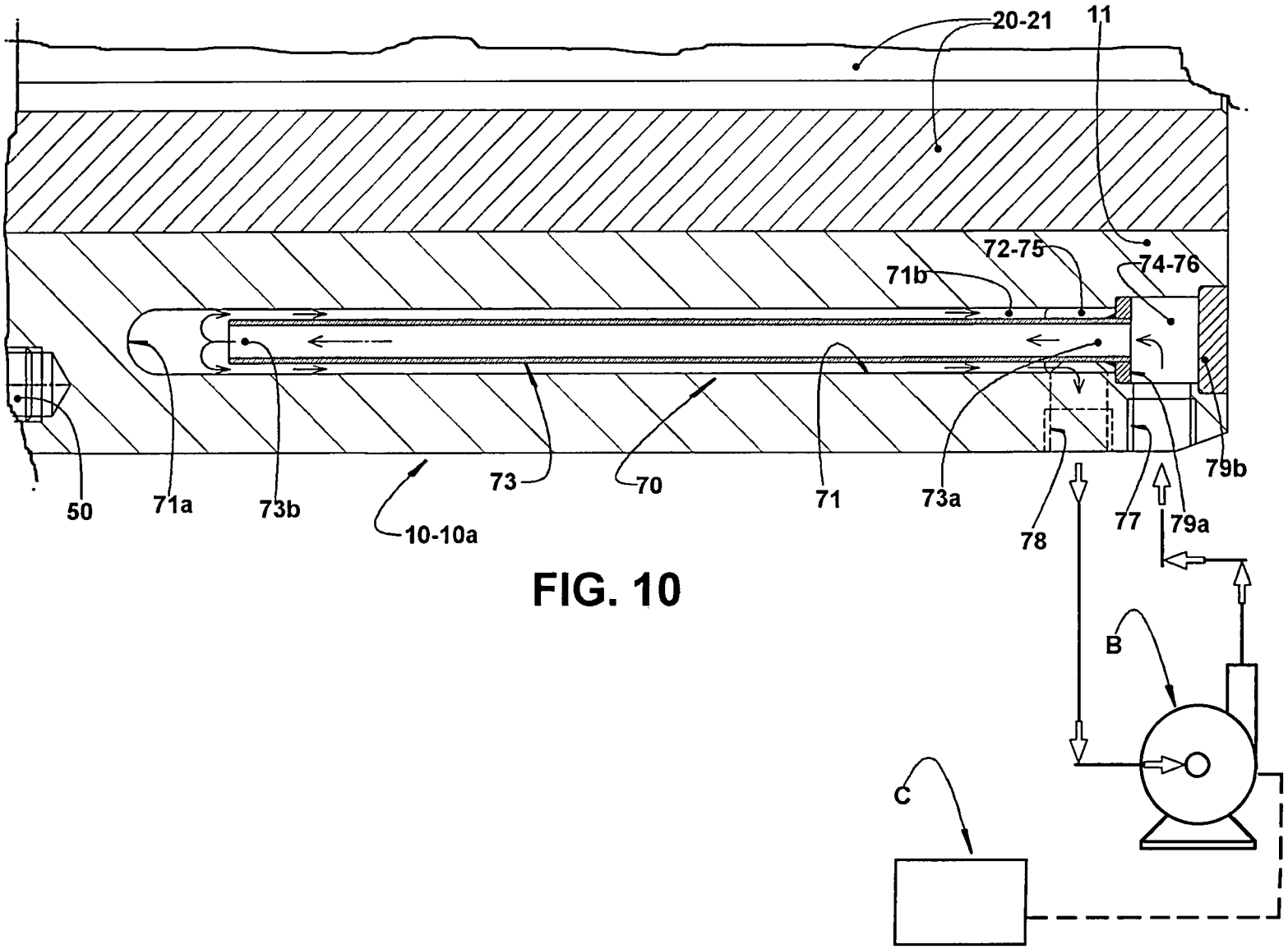
FIG. 10 represents a partial longitudinal sectional view of the injection chamber illustrated in FIGS. 2, 4 and 6, said section taken according to line X-X in FIG. 9.
Figure 11:
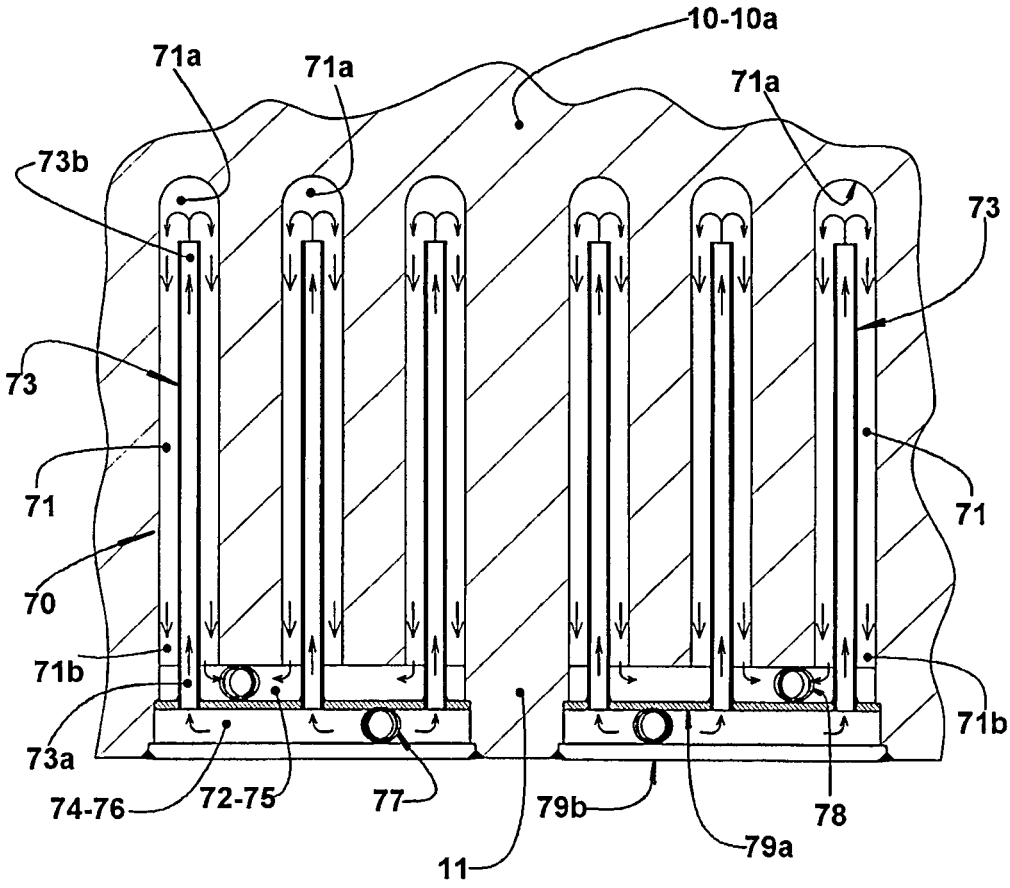
FIG. 11 represents a partial sectional plan view of the circumferential region of the injection chamber of FIGS. 2, 4 and 6 and containing the duct assemblies for the circulation of a thermal transfer fluid, said section taken according to line XI-XI in FIG. 9.

Considering the need to control the temperature in the interior of the supply portion 10*a* of the tubular body 10, the invention further provides, in the thickness of the lower half of the supply portion 10*a*, at least one duct assembly 70 for the circulation of a thermal transfer fluid. In the illustrated construction better represented in FIGS. 9, 10 and 11, there are provided two duct assemblies 70, each comprising a plurality of blind axial holes 71, extended along the supply portion 10*a* and having a closed end 71*a* and a discharge end 71*b* opened to a discharge collector 72. Each duct assembly 70 further comprises a plurality of inlet tubes 73, each being disposed with a radial gap in the interior of a respective blind axial hole 71 and presenting an inlet end 73*a* opened to an inlet collector 74 and an outlet end 73*b* which is opened and axially spaced back in relation to the closed end 71*a* of the respective blind axial hole 71. The inlet collector 74 and discharge collector 72 are connected to a pumping unit B, so as to cause the thermal transfer fluid to pass through the duct assembly 70, exchanging heat with the supply portion 10*a*, according to a flowrate adjusted by a control unit C, as a function of the desired temperature for the region of the supply portion 10*a* which receives the charge of molten metal MF.

In the illustrated construction, the inlet collector 74 and discharge collector 72 are defined by recesses 75, 76 provided in the mounting end 11 in the supply portion 10*a* of the tubular body 10 and connected to the pumping unit B through radial nozzles 77, 78 provided in said tubular body 10.

In the illustrated construction, the recesses 75, 76 are axially overlapped and separated from each other by an inner lining 79*a*, which is peripherally and hermetically affixed to the supply portion 10*a*, for example by welding, and trespassed by the inlet ends 73*a* of the inlet tubes 73 welded thereto, the discharge collector 72 being defined between the inner lining 79*a* and the bottom of the innermost recess 75 and the inlet collector 74 being defined between the inner lining 79*a* and an outer lining 79*b* which is peripherally and hermetically affixed, for example by welding, to the mounting end 11 of the supply, portion 10*a*, closing the outermost recess 76.

With this construction, the temperature control fluid, for example, water or any other fluid, can be controllably pumped to the interior of the inlet collector 74 and, therefrom, equally distributed to the interior of the inlet tubes 73, returning through the annular space formed between the latter and the inner wall of the respective blind axial hole 71, until reaching the discharge collector 72, in order to return to the pumping unit B.

With this construction, it is possible to obtain a high efficiency with the balanced and homogeneous thermal exchange, in the reduced thickness region of the supply portion 10*a* of the tubular body 10, allowing that the temperature of this region of the injection chamber CI remains within adequate values for the correct operation of the injection system.

While only one embodiment for the invention has been illustrated herein, it should be understood that alterations can be made in the form and physical arrangement of different component parts, without departing from the constructive concept defined in the claims that accompany the present specification.

The invention claimed is:

1. An injection chamber for a metal injection machine provided with mold portions which define a molding cavity, said injection chamber (CI) comprising: a tubular body, having a cylindrical inner surface and being formed by a supply portion provided with a closed mounting end and with a radial supply window for pouring a charge of molten metal (MF) in the interior of the injection chamber (CI), and by an injection portion coaxially incorporated to the supply portion and provided with an outlet end, opened to the interior of the molding cavity; and a piston to be axially displaced in the interior of the tubular body, between a retracted position adjacent to the mounting end, and an injection position adjacent to the outlet end, the injection chamber (CI) being characterized in that the supply portion of the tubular body has at least a region of its cylindrical inner surface, which receives the impact of the charge of molten metal (MF) downwardly poured through the radial supply window lined by an insert, formed in a high melting point material and presenting a cross section with its inner contour in the form of a circle arc coinciding with that of the supply portion and the injection portion and with its outer contour contained inside the outer contour of the supply portion.

2. The injection chamber, as set forth in claim 1, characterized in that the insert comprises a plurality of insert portions disposed axially and adjacent to each other, side-by-side, each insert portion presenting a trapezoidal cross section with a smaller base, in concave circular arc, turned radially inwards.

3. The injection chamber, as set forth in claim 1, characterized in that the insert is seated on a respective recess provided on the cylindrical inner surface, and locked therein, in at least one of axial and radial directions, by pins and screws radially provided through the tubular body.

4. The injection chamber, as set forth in claim 1, characterized in that the insert is formed in a single piece, in the form of a cylindrical sleeve, lining the whole circumferential extension of the supply portion and presenting a radial opening aligned with the radial supply window.

5. The injection chamber, as set forth in claim 4, characterized in that the insert is seated in a respective recess provided in the cylindrical inner surface and locked therein, in an axial direction, by any retention means defined by pins and screws, radially provided through the tubular body.

6. The injection chamber, as set forth in claim 1, characterized in that the insert is formed in a single piece, in the form of a half chute turned upwards and lining a lower circumferential extension of the supply portion and having end longitudinal edges disposed in a diametrical plane inclined in relation to a horizontal orientation and orthogonal to a pouring direction of the molten metal (MF).

7. The injection chamber, as set forth in claim 1, characterized in that the insert lines the whole axial extension of the supply portion.

8. The injection chamber, as set forth in claim 1, characterized in that the supply portion and the injection portion are defined by different pieces coaxially seated and affixed to each other.

9. The injection chamber, as set forth in claim 8, characterized in that one of the supply portion and injection portion is provided with an end guide means to be axially fitted in an end guide receiving means provided in the other of said portions of the tubular body.

10. The injection chamber, as set forth in claim 9, characterized in that the end guide means is defined by a central axial projection of one of the injection portion and supply portion, the end guide receiving means being defined by a central recess provided in the adjacent end of the other of said portions of the tubular body and dimensioned to tightly receive the central axial projection when the portions of the tubular body are affixed to each other.

11. The injection chamber, as set forth in claim 8, characterized in that the injection portion is provided with a plurality of peripheral recesses, circumferentially spaced apart and each defining an end flange portion and housing the head of a screw, which projects through a hole in a respective flange portion so as to be engaged in an end threaded hole of the supply portion, affixing the supply portion in the injection portion.

12. The injection chamber, as set forth in claim 8, characterized in that the supply portion and injection portion are affixed to each other in a mutual seating region by a peripheral welding.

13. The injection chamber, as set forth in claim 8, characterized in that a recess of the region of the cylindrical inner surface of the supply portion, which recess is lined with the insert, presents a median step turned to the injection portion, the insert being provided with an inverted step, turned to the closed mounting end and which is seated against the median step, locking the insert against axial displacements towards the mounting end.

14. The injection chamber, as set forth in claim 8, characterized in that the insert has its opposite ends welded to the supply portion.

15. The injection chamber, as set forth in claim 8, characterized in that the insert is locked, in at least one of axial and radial directions, by any retention means defined by pins and screws, radially provided through the tubular body.

16. The injection chamber, as set forth in claim 1, characterized in that the supply portion is provided, in a thickness of its lower half, with at least one duct assembly for a circulation of a thermal transfer fluid and which comprises: a plurality of blind axial holes, extended along the supply portion and having a closed end and a discharge end opened to a discharge collector; and a plurality of inlet tubes, each being disposed with a radial gap in the interior of a respective blind axial hole and presenting an inlet end opened to an inlet collector and an outlet end opened and axially spaced back in relation to the closed end of the respective blind axial hole, said inlet collector and the discharge collector being connected to a pumping unit (B), so as to make the thermal transfer fluid pass through the duct assembly, according to a flowrate adjusted by a control unit (C), as a function of a temperature desired for the region of the cylindrical inner surface of the supply portion which receives the charge of molten metal (MF).

17. The injection chamber, as set forth in claim 16, characterized in that the inlet collector and the discharge collector are defined by recesses, which are provided in the mounting end of the supply portion and connected to the pumping unit (B) through radial nozzles provided in said tubular body.

18. The injection chamber, as set forth in claim 17, characterized in that the recesses are axially overlapped and separated from each other by an inner lining, which is peripherally and hermetically affixed to the supply portion and trespassed by the inlet ends of the inlet tubes, the discharge collector being defined between the inner lining and the bottom of an innermost recess and the inlet collector being defined between the inner lining and an outer lining which is peripherally and hermetically affixed to the mounting end of the supply portion.

* * * * *